US010730170B2

(12) United States Patent
Schuster et al.

(10) Patent No.: US 10,730,170 B2
(45) Date of Patent: Aug. 4, 2020

(54) UNIVERSAL AERATOR REMOVAL AND INSTALLATION TOOL

(71) Applicant: Danco, Inc., Irving, TX (US)

(72) Inventors: Michael J. Schuster, Shorewood, IL (US); Douglas C. Saunders, Shorewood, IL (US)

(73) Assignee: Danco, Inc., Irving, TX (US)

( * ) Notice: Subject to any disclaimer, the term of this patent is extended or adjusted under 35 U.S.C. 154(b) by 54 days.

(21) Appl. No.: 16/105,223

(22) Filed: Aug. 20, 2018

(65) Prior Publication Data

US 2019/0061114 A1 Feb. 28, 2019

Related U.S. Application Data

(60) Provisional application No. 62/548,703, filed on Aug. 22, 2017.

(51) Int. Cl.

| | |
|---|---|
| ***B25B 13/50*** | (2006.01) |
| ***B25B 13/54*** | (2006.01) |
| ***B25B 13/06*** | (2006.01) |
| ***B25F 1/02*** | (2006.01) |
| ***B25B 13/10*** | (2006.01) |
| ***B25B 23/00*** | (2006.01) |
| ***B67B 7/16*** | (2006.01) |

(52) U.S. Cl.

CPC ..... *B25B 13/50* (2013.01); *B25B 13/065* (2013.01); *B25B 13/10* (2013.01); *B25B 13/54* (2013.01); *B25B 23/0007* (2013.01); *B25F 1/02* (2013.01); *B67B 7/16* (2013.01)

(58) Field of Classification Search

CPC ..... B25B 13/065; B25B 13/10; B25B 13/50; B25B 13/54; B25B 23/0007; B25F 1/02; B67B 7/16

See application file for complete search history.

(56) References Cited

U.S. PATENT DOCUMENTS

| | | | | | |
|---|---|---|---|---|---|
| 167,368 | A * | 8/1875 | Waitt | B25B 13/48 | 81/120 |
| 564,625 | A * | 7/1896 | Kelsea | B25B 13/08 | 81/119 |
| 1,470,528 | A * | 10/1923 | Flentjen | F16B 39/36 | 411/237 |
| 1,640,383 | A * | 8/1927 | Thomas | B25B 13/04 | 81/176.15 |
| 4,580,469 | A * | 4/1986 | Lordahl | B25F 1/00 | 81/437 |
| 5,038,644 | A * | 8/1991 | Delsack | B25B 3/00 | 7/142 |

(Continued)

*Primary Examiner* — Jacob J Cigna

(74) *Attorney, Agent, or Firm* — Thomas | Horstemeyer, LLP

(57) ABSTRACT

Disclosed are various embodiments for a universal aerator removal and installation tool, which may include a tool for rotationally engaging and turning an aerator coupled to a faucet spout. The tool may include a tool body having a first end and a second end and various keys positioned at the first end of the tool body. Each of the keys may include projections configured to rotationally engage and turn a different type of aerator. One or more aerator wrenches may be positioned at the second end of the tool body, where the aerator wrenches may project from the tool body and be configured to rotationally engage and turn different types of aerators.

20 Claims, 23 Drawing Sheets

(56) References Cited

U.S. PATENT DOCUMENTS

| | | | | | |
|---|---|---|---|---|---|
| 5,216,941 | A * | 6/1993 | Kolvereid | B25B 13/48 | 285/39 |
| 5,259,281 | A * | 11/1993 | Burke | B25B 13/04 | 7/138 |
| 5,652,988 | A * | 8/1997 | Appelhoff | B25F 1/00 | 7/151 |
| 6,257,099 | B1 * | 7/2001 | Rosenbaum | B25B 13/48 | 81/124.4 |
| 6,971,591 | B2 * | 12/2005 | Fleischmann | E03C 1/084 | 239/428.5 |
| D542,105 | S * | 5/2007 | Grether | D8/28 | |
| D596,001 | S * | 7/2009 | Stein | D8/28 | |
| D601,393 | S * | 10/2009 | Cui | D8/17 | |
| 9,303,393 | B2 * | 4/2016 | Bush | E03C 1/084 | |
| 9,452,511 | B2 * | 9/2016 | Nguyen | B23B 31/201 | |
| D815,932 | S * | 4/2018 | Lee | D8/27 | |
| 2007/0283789 | A1 * | 12/2007 | Zeidler | B25B 13/56 | 81/125.1 |
| 2009/0007977 | A1 * | 1/2009 | Wildfang | E03C 1/08 | 137/801 |
| 2009/0293684 | A1 * | 12/2009 | Hughett | B25B 13/02 | 81/121.1 |
| 2014/0143958 | A1 * | 5/2014 | Barr | B25F 1/00 | 7/138 |

* cited by examiner

UNIVERSAL AERATOR REMOVAL AND INSTALLATION TOOL

CROSS-REFERENCE TO RELATED APPLICATION

This application claims the benefit of and priority to U.S. Provisional Patent Application No. 62/548,703 entitled "UNIVERSAL AERATOR REMOVAL AND INSTALLATION TOOL," filed Aug. 22, 2017, the contents of which being incorporated by reference in their entirety herein.

BACKGROUND

Most faucets include an aerator, also referred to as a faucet aerator or a tap aerator, that mixes air and water coming out of the faucet to provide a softened stream of water that reduces splashing. The aerator is often found at the tip of modern indoor water faucets. For instance, most aerators are able to be screwed into a delivery end of a water faucet spout. Some aerators include small openings about its perimeter that draw air into the water that flows through the aerator. The water is thereby delivered having small air bubbles contained within the stream. Different types of aerators offer different flow rates to suit different applications and are often constructed different based on its manufacturer. Accordingly, a tool for removing or installing an aerator is often required that is specific to a particular manufacturer.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

Figure 1:
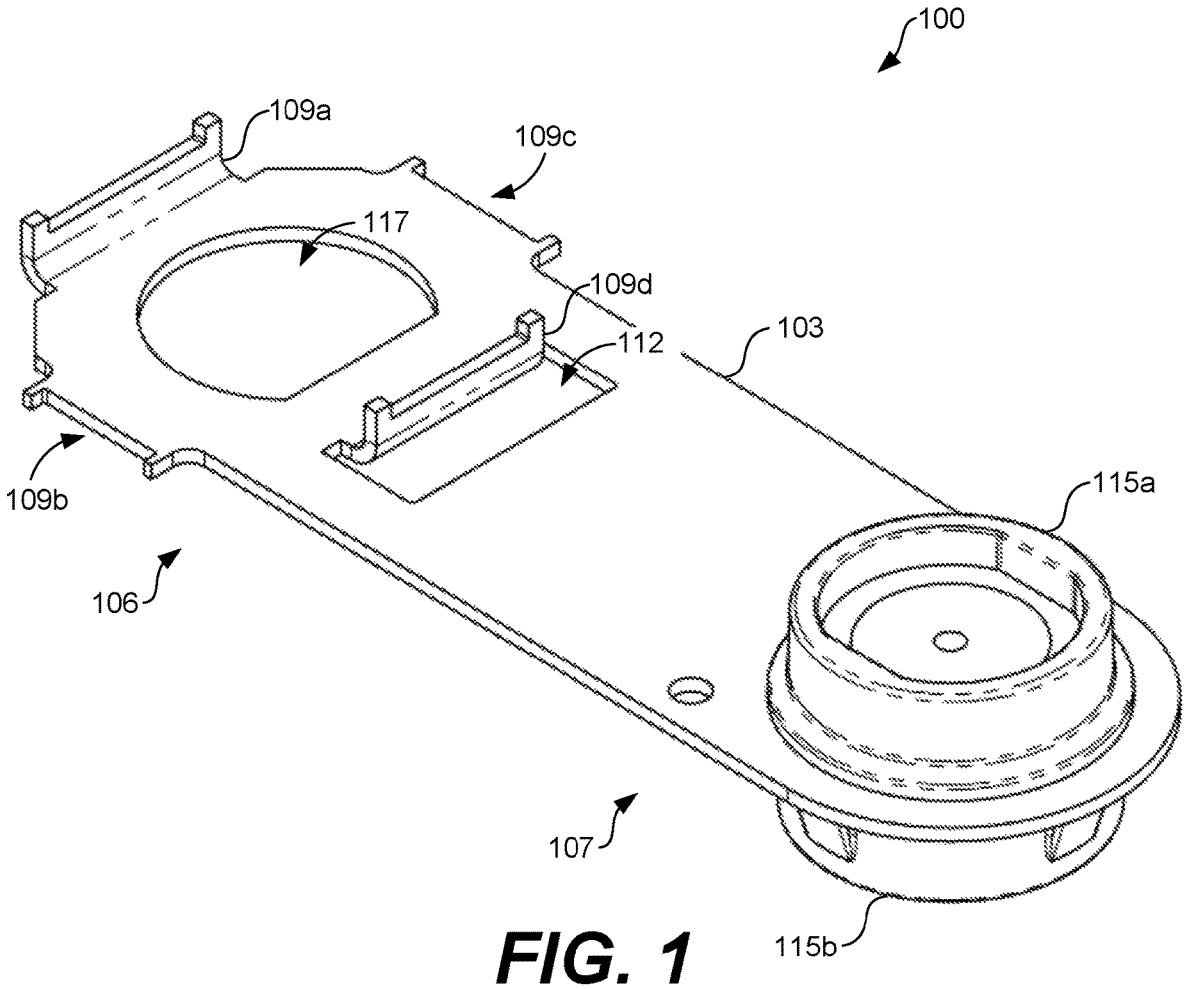
FIG. 1 is a top perspective view of a universal aerator tool according to various embodiments of the present disclosure.

The present disclosure relates to a universal tool that facilitates the installation and removal of a flow control member, illustratively an aerator, within or otherwise coupled to a faucet spout. According to various embodiments, a universal aerator tool is described for rotationally engaging and turning an aerator coupled to a faucet spout. The universal aerator tool may include a tool body having a first end and a second end. A plurality of keys may be positioned at the first end of the tool body, where at least one of the plurality of keys comprises a plurality of projections configured to rotationally engage and turn a first type of aerator. At least one aerator wrench may be positioned at the second end of the tool body, where the at least one aerator wrench projects from the tool body and is configured to rotationally engage and turn a second type of aerator. In some embodiments, the universal aerator tool may be configured to rotationally engage and turn up to six different types of aerators as well as both cache-type aerators and external-type aerators. In the following discussion, a general description of the universal aerator tool and its components is provided, followed by a discussion of the operation of the same.

With reference to FIGS. 1-10, a universal aerator tool 100 is shown according to various embodiments. Generally, the universal aerator tool 100 may be configured to rotationally engage and turn various of types of aerators (not shown) positioned within or otherwise coupled to a faucet spout (not shown). For instance, the universal aerator tool 100 may be configured to rotationally engage and turn one or more of M24x1 (Regular), M21.5x1 (Junior), M18.5x1 (Tiny Junior), M16.5x1 (TOM THUMB), M18x1, or other type of aerator. The universal aerator tool 100 may include a tool body 103 having a first end 106 and a second end 107. The tool body 103 may be an elongated tool body and the second end 107 may include rounded edges. In some embodiments, at least a portion of the tool body 103 may be magnetic.

The universal aerator tool 100 may include one or more keys 109*a* . . . 109*d* (collectively "keys 109"). In various embodiments, the keys 109 may be positioned at the first end 106 of the tool body 103. Each of keys 109 may include projections configured to rotationally engage and turn a particular type of aerator. Generally, the keys 109 may be used to rotationally engage and turn cache-type aerators (also referred to "hidden aerators") that are commonly disposed within or are internal to a faucet spout. According to various embodiments, the keys 109 include a first key 109*a* curvedly projecting from a distal end of the tool body 103. The first key 109*a* may be configured to rotationally engage and turn the first type of aerator using a pair of projections that may be positioned in recesses of the aerator. The keys 109 may also include a second key 109*b* positioned on a first side of the tool body 103 and a third key 109*c* positioned on a second side of the tool body 103 opposite that of the first side. The second key 109*b* and the third key 109*c* may be configured to rotationally engage and turn a second type and a third type of aerator using a pair of projections, respectively. The first key 109*a*, the second key 109*b*, and the third key 109*c* may form a T-shaped or a cross-shaped portion of the tool body 103 by virtue of their placement on the tool body 103.

The keys 109 may further include a fourth key 109*d* curvedly projecting outward from a central portion of the tool body 103. In some embodiments, the fourth key 109*d* has a projection height substantially similar to a projection height of the first key 109*a*. In other words, the first key 109*a* and the fourth key 109*d* may project outwards a same distance. The fourth key 109*d* may be configured to rotationally engage and turn a fourth type of aerator. The spacing between the projections, as well as a height of the projections, may be formed such that the corresponding key 109 is configured for a particular type of aerator.

The fourth key 109*d* may be formed at a rectangular aperture 112 of the tool body 103 in some embodiments. The placement of the fourth key 109*d* may be determined such that the fourth key 109*d* does not interfere with a rotation of the tool body 103 when, for example, the second key 109*b* or the third key 109*c* are used to install or remove an aerator. The rectangular aperture 112 may facilitate placement of a finger or other portion of the hand when turning an aerator using the fourth key 109*d*. Although the rectangular aperture 112 is described as being rectangular, in various embodiments, the rectangular aperture 112 may include an aperture that is circular, ovular, square, or other suitable shape.

The universal aerator tool 100 may further include one or more aerator wrenches 115*a* . . . 115*b* (collectively "aerator wrenches 115"). In various embodiments, and as shown in the non-limiting example of FIG. 1, the universal aerator tool 100 may include two aerator wrenches 115, both positioned at the second end 107 of the tool body 103. Additionally, the aerator wrenches 115 may project outwards from a surface of the tool body 103 and may be configured to rotationally engage and turn a fifth type of aerator and a sixth type or aerator, respectively.

More specifically, the aerator wrenches 115 may include a first aerator wrench 115*a* projecting from a top side of the tool body. The first aerator wrench 115*a* may be configured to rotationally engage and turn a fifth type of aerator. The aerator wrenches 115 may further include a second aerator wrench 115*b* projecting from a bottom side of the tool body, where the second aerator wrench 115*b* is configured to rotationally engage and turn a sixth type of aerator. The tool body 103 may further include an aperture 117 operationally configured to receive and leverage a bottle cap off of a bottle, as will be discussed. Additionally, the aperture 117 may facilitate placement of a finger or other portion of the hand when turning an aerator using one of the keys 109.

Figure 2:
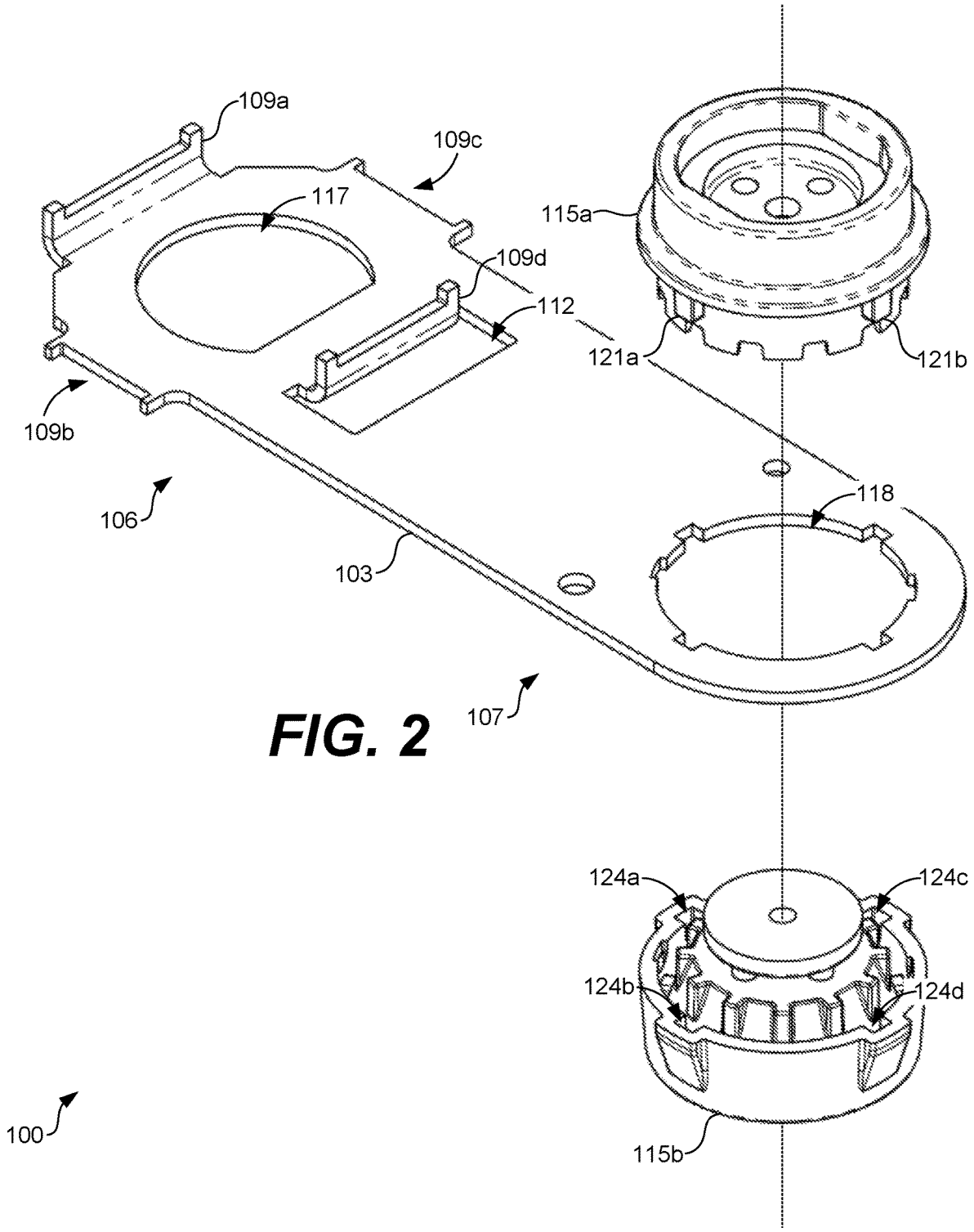
FIG. 2 is an exploded top perspective view of the universal aerator tool according to various embodiments of the present disclosure.

Referring now to FIG. 2, an exploded view of the universal aerator tool 100 is shown. The first aerator wrench 115*a* and the second aerator wrench 115*b* may be coupled through an aperture 118 positioned at the second end 107 of the tool body 103 using a plurality of tabs 121*a* . . . 121*d* (collectively "tabs 121"). As a bottom of the first aerator wrench 115*a* may be configured to substantially conform to a top of the second aerator wrench 115*b*, a coupling between the first aerator wrench 115*a* and the second aerator wrench 115*b* may be formed by positioning the tabs 121 in a plurality of tab recesses 124*a* . . . 124*d* (collectively "tab recesses 124"). The tabs 121 and the tab recesses 124 may snap or otherwise lock into place, thereby forming a detachably attached connection or, in other embodiments, may be over molded and permanently attached. When coupled, the tool body 103 may be positioned between the first aerator wrench 115*a* and the second aerator wrench 115*b*. The aperture 118 may be formed to have a shape that substantially conforms to a body of the first aerator wrench 115*a* and the second aerator wrench 115*b*. The first aerator wrench 115*a* and/or the second aerator wrench 115*b*, or a portion thereof, may be formed of a hard plastic, such as acrylonitrile butadiene styrene (ABS), polyvinyl chloride (PVC), polyoxymethylene (POM), polypropylene (PP), or other materials. In some embodiments, the second aerator wrench 115*b* may be formed of a different material than that of the first aerate wrench 115. To this end, in some embodiments, the second aerator wrench 115*b* may be formed using injection grade silicone, thermoplastic elastomers (TPE), thermoplastic rubber (TPR), or other rubber or rubber line materials.

Figure 3:
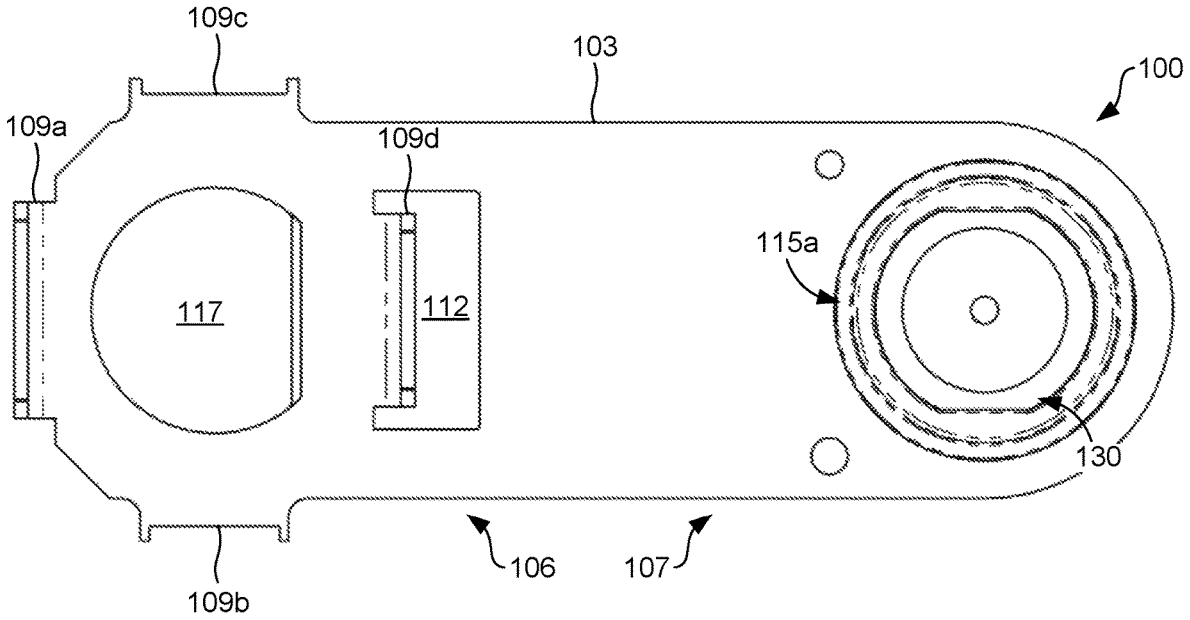
FIG. 3 is a top plan view of the universal aerator tool according to various embodiments of the present disclosure.
Figure 4:
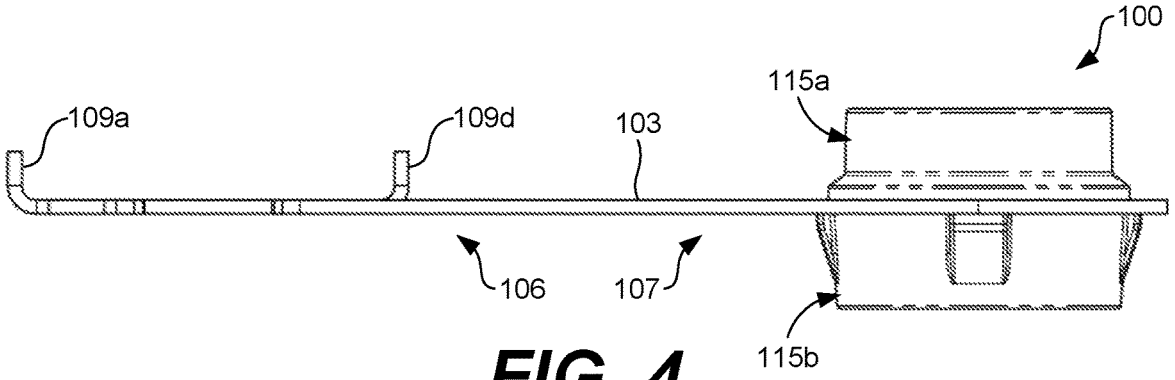
FIG. 4 is a side view of the universal aerator tool according to various embodiments of the present disclosure.
Figure 5:
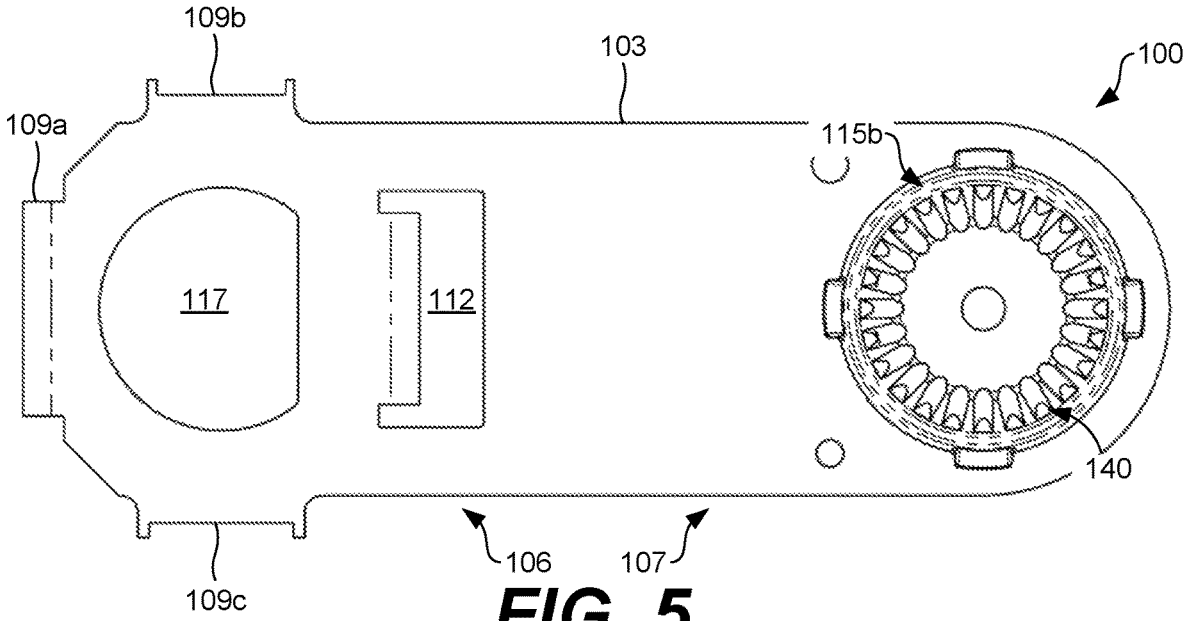
FIG. 5 is a bottom plan view of the universal aerator tool according to various embodiments of the present disclosure.
Figure 6:
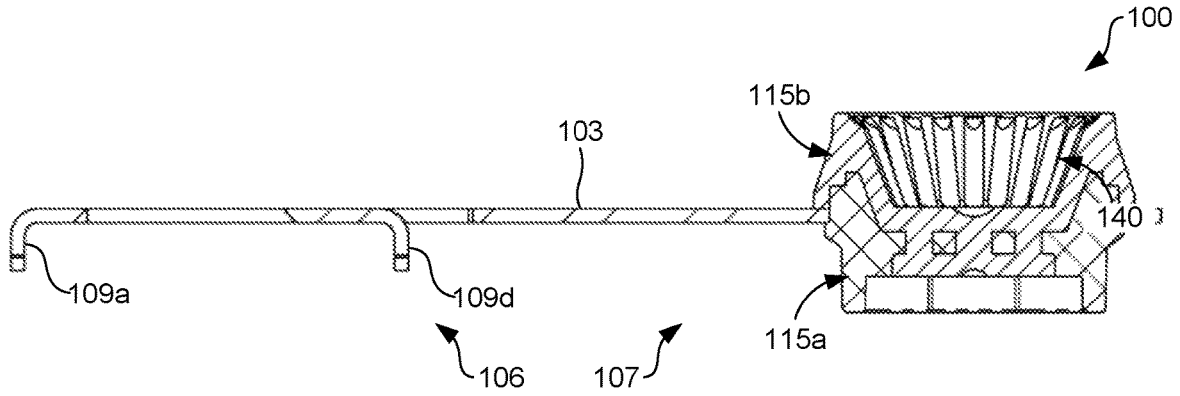
FIG. 6 is a side cross-sectional view of the universal aerator tool according to various embodiments of the present disclosure.
Figure 7:
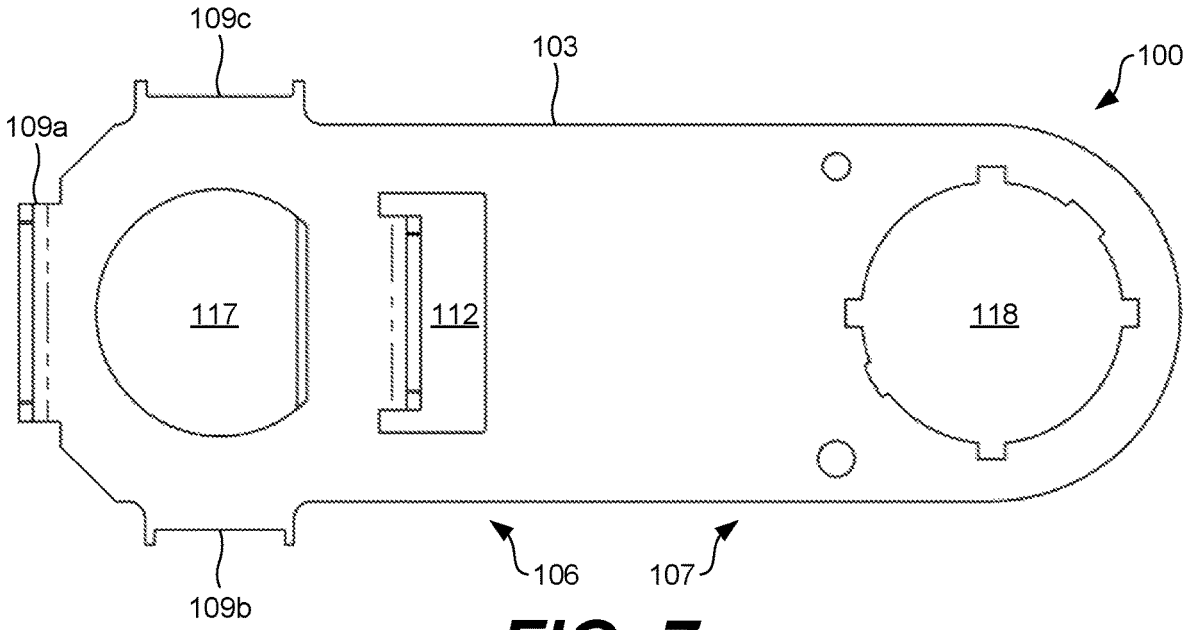
FIG. 7 is a top plan view of the universal aerator tool with no aerator wrenches shown according to various embodiments of the present disclosure.
Figure 8:
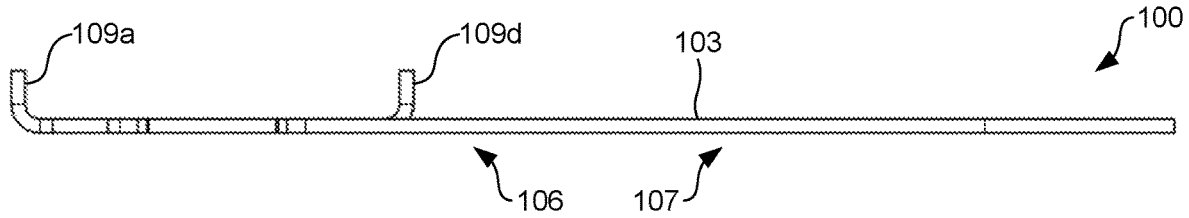
FIG. 8 is a side view of the universal aerator tool with no aerator wrenches shown according to various embodiments of the present disclosure.
Figure 9:
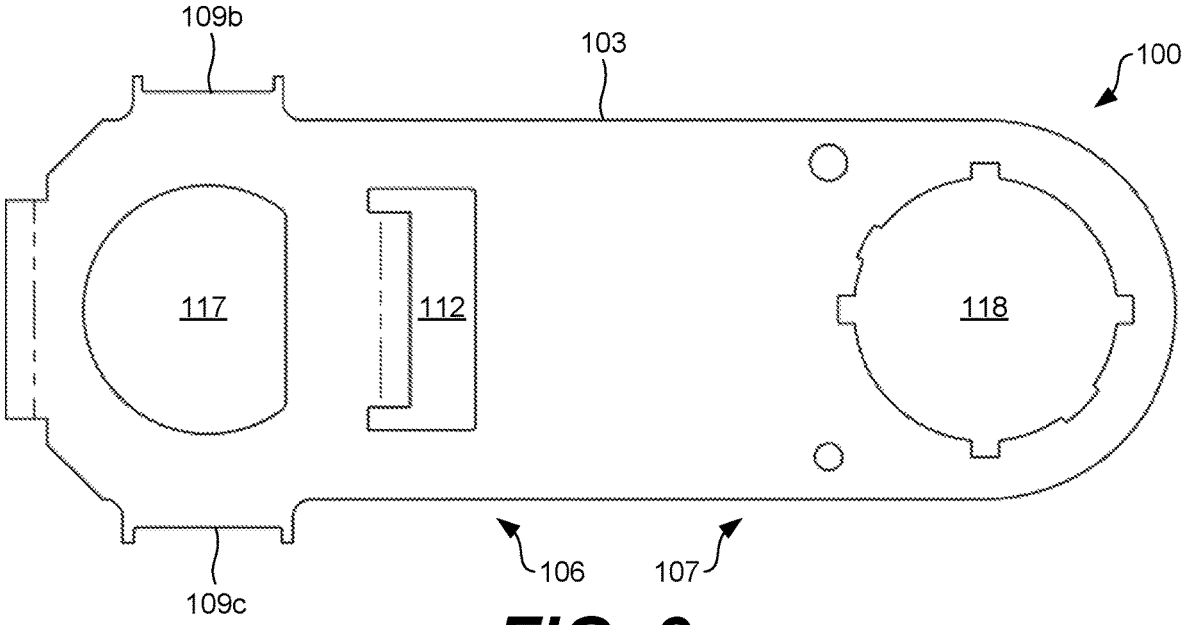
FIG. 9 is a bottom plan view of the universal aerator tool with no aerator wrenches shown according to various embodiments of the present disclosure.
Figure 10:
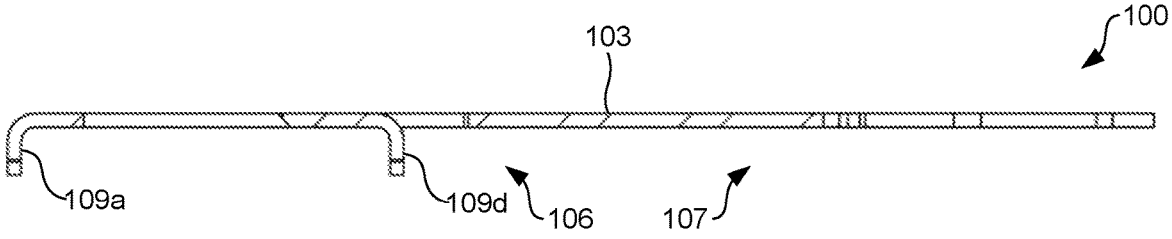
FIG. 10 is a side view of the universal aerator tool with no aerator wrenches shown according to various embodiments of the present disclosure.
Figure 11:
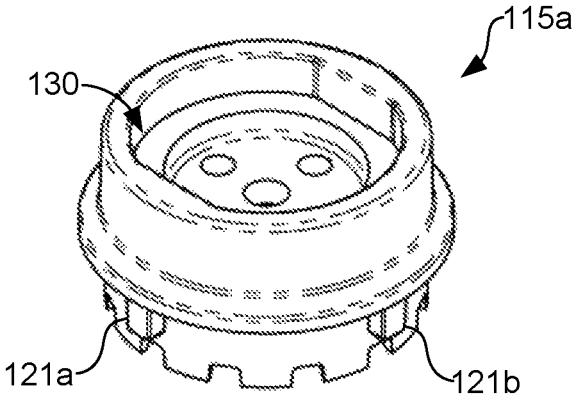
FIGS. 11-16 are various views of a aerator wrench for use in the universal aerator tool according to various embodiments of the present disclosure.
Figure 12:
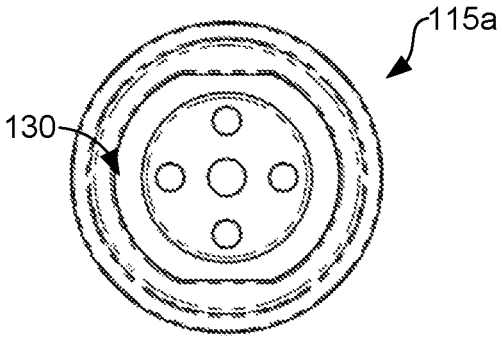
Figure 13:
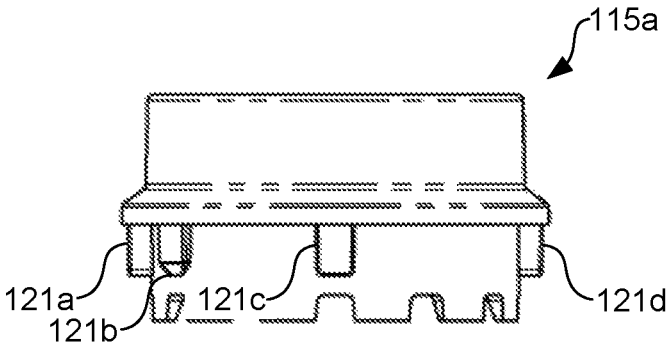
Figure 14:
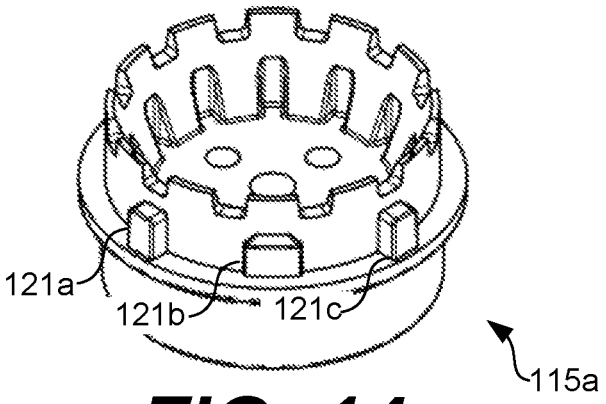
Figure 15:
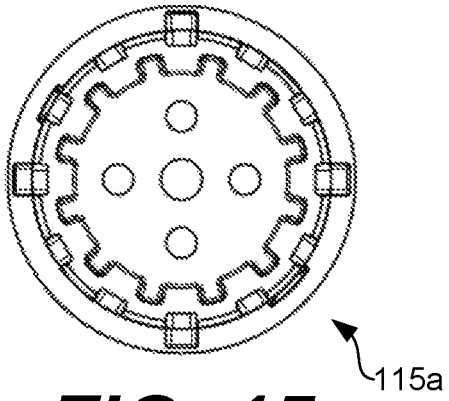

Moving on to FIGS. 3, 4, and 5, a top plan view, a side view, and a bottom view of the universal aerator tool 100 is shown having the first aerator wrench 115*a* and the second aerator wrench 115*b* coupled, respectively. FIG. 6 includes a side cross-sectional view of the universal aerator tool 100 to better illustrate an internal configuration of the first aerator wrench 115*a* and the second aerator wrench 115*b*. For instance, the first aerator wrench 115*a* may include a partially circular recess 130 having with two parallel flat edges at opposing sides of the partially circular recess 130 to engage an M24x1 type of aerator, M28x1 type of aerator, and/or M18x1 type of aerator. In various embodiments, the partially circular recess 130 may be formed of plastic and a housing of the second aerator wrench 115*b* may include metal, plastic, or a combination thereof.

As shown in the bottom plan view of FIG. 5 and the side cross-sectional view of FIG. 6, in some embodiments, the second aerator wrench 115*b* may include a circular ridged recess 140 having a plurality of ridges configured to rotational engage and turn a corresponding type of aerator. The ridges may project axially and outwardly from the tool body 103. In other words, a diameter of the bottom of the ridges may be less than a diameter of the top of the ridges. In various embodiments, the circular ridged recess 140 may be formed of plastic and a housing of the second aerator wrench 115*b* may include metal, plastic, or a combination thereof. In some embodiments, the first aerator wrench 115*a* and the second aerator wrench 115*b* may be replaced with another type of wrench 115 depending on a type of aerator to be removed or installed.

Figure 16:
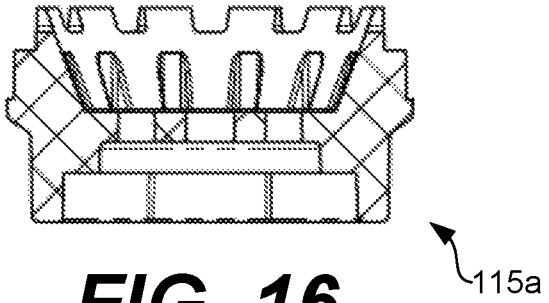
Figure 17:
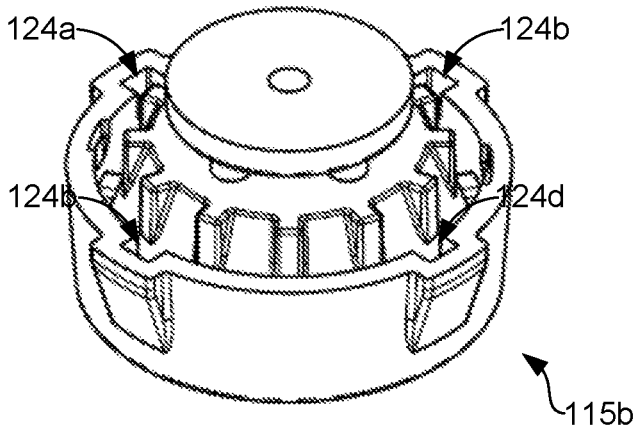
FIGS. 17-22 are various views of another aerator wrench for use in the universal aerator tool according to various embodiments of the present disclosure.
Figure 18:
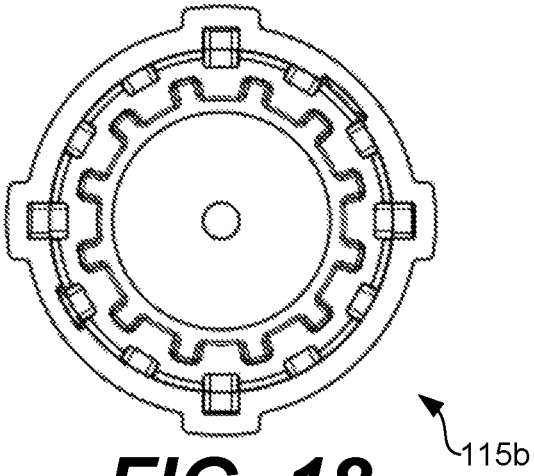
Figure 19:
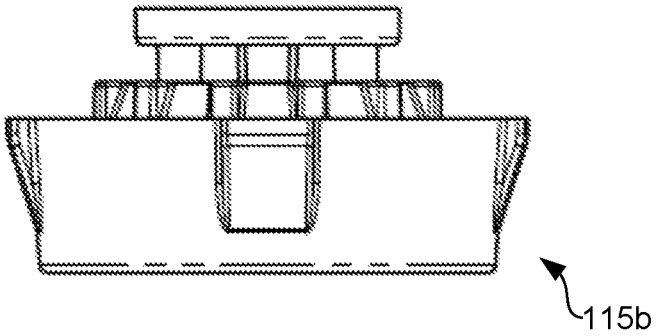
Figure 20:
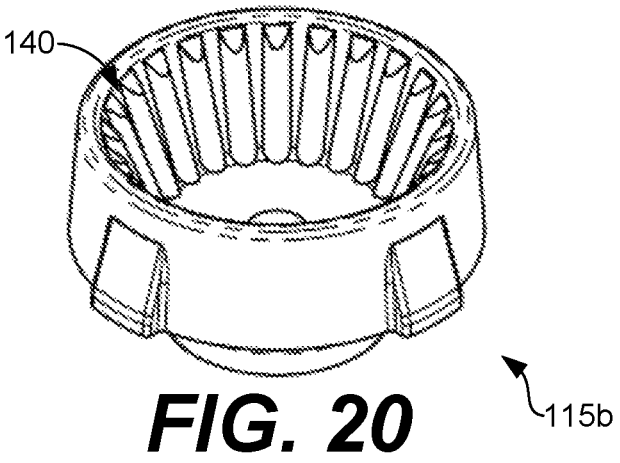
Figure 21:
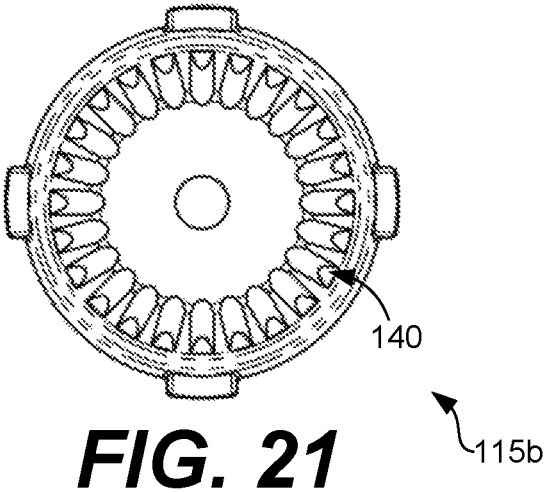
Figure 22:
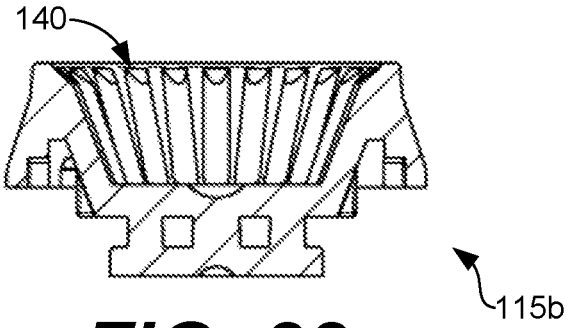
Figure 23:
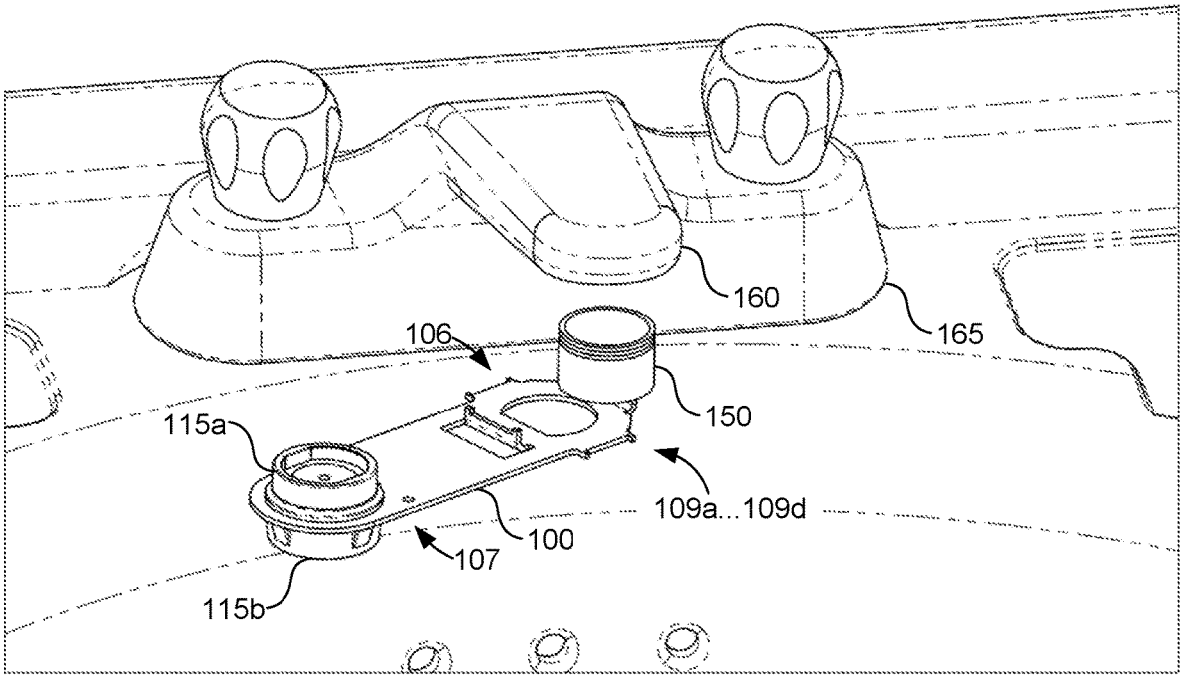
FIGS. 23-34 are various views showing an example operation of the universal aerator tool according to various embodiments of the present disclosure.
Figure 24:
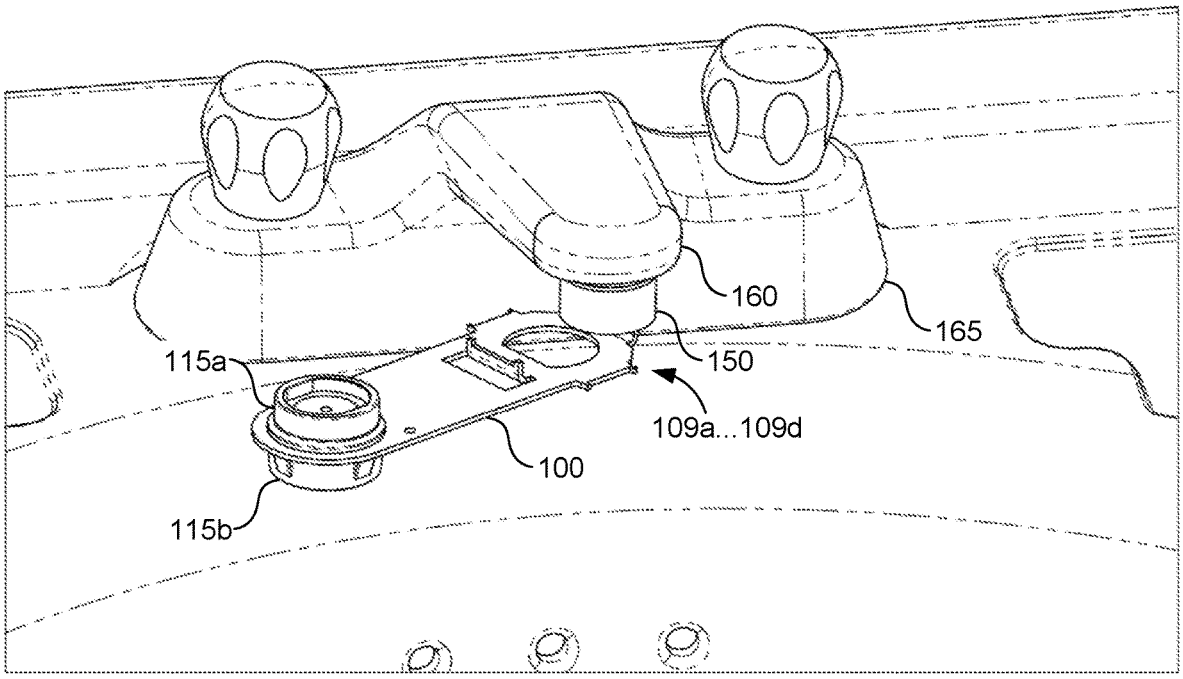
Figure 25:
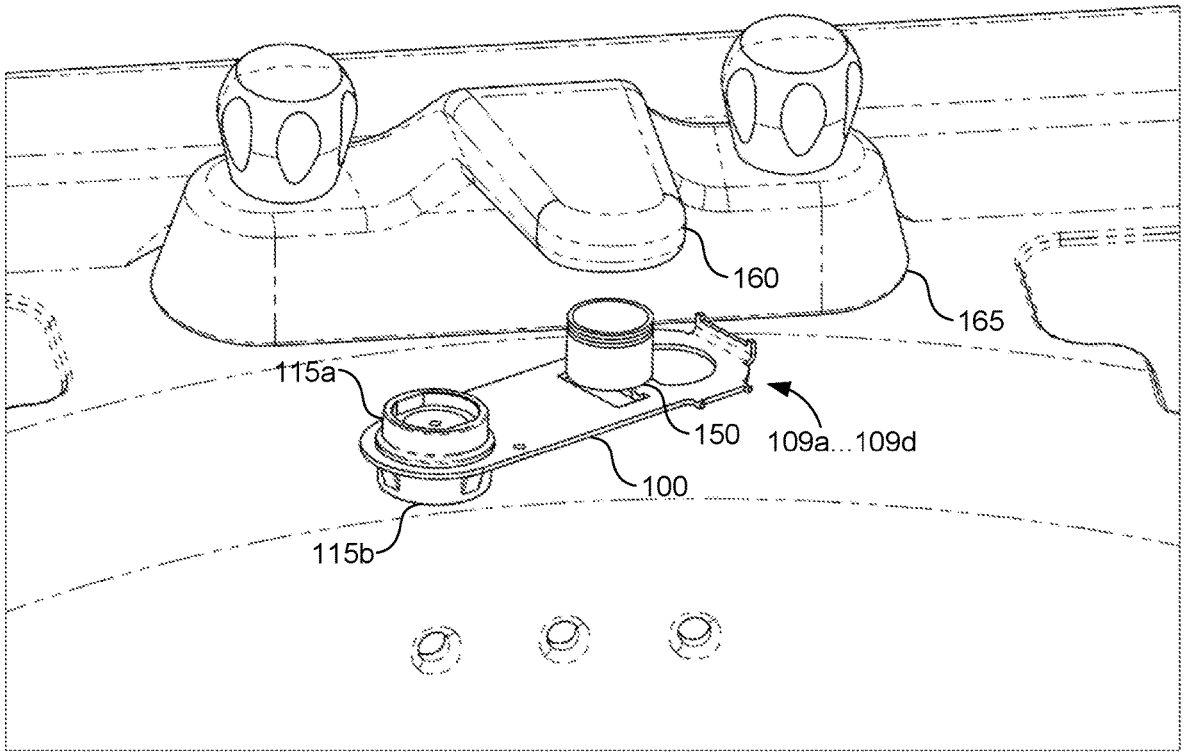
Figure 26:
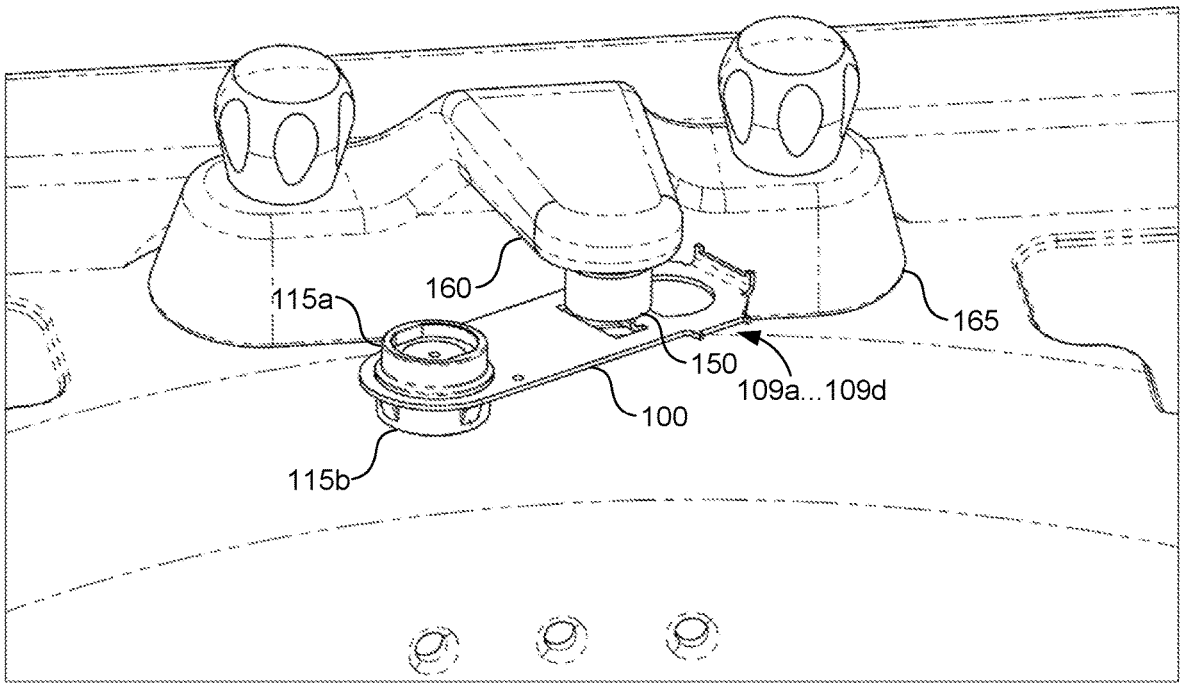
Figure 27:
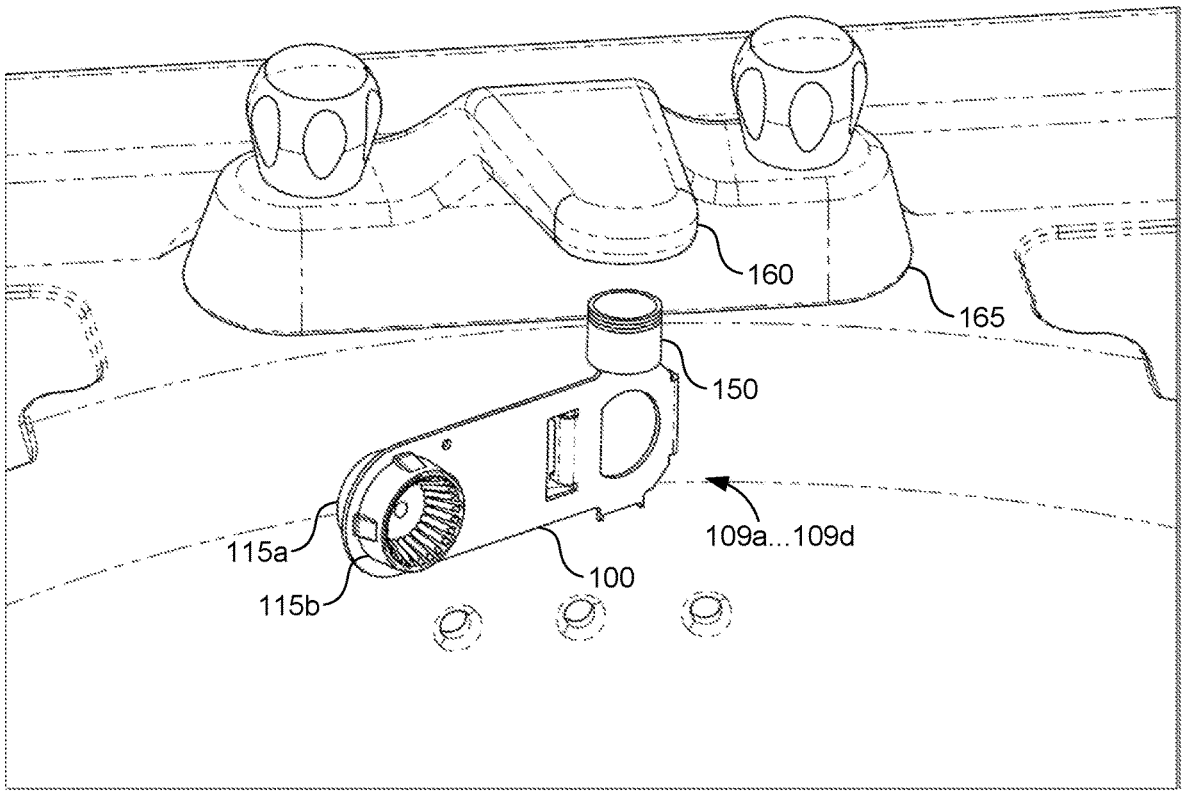
Figure 28:
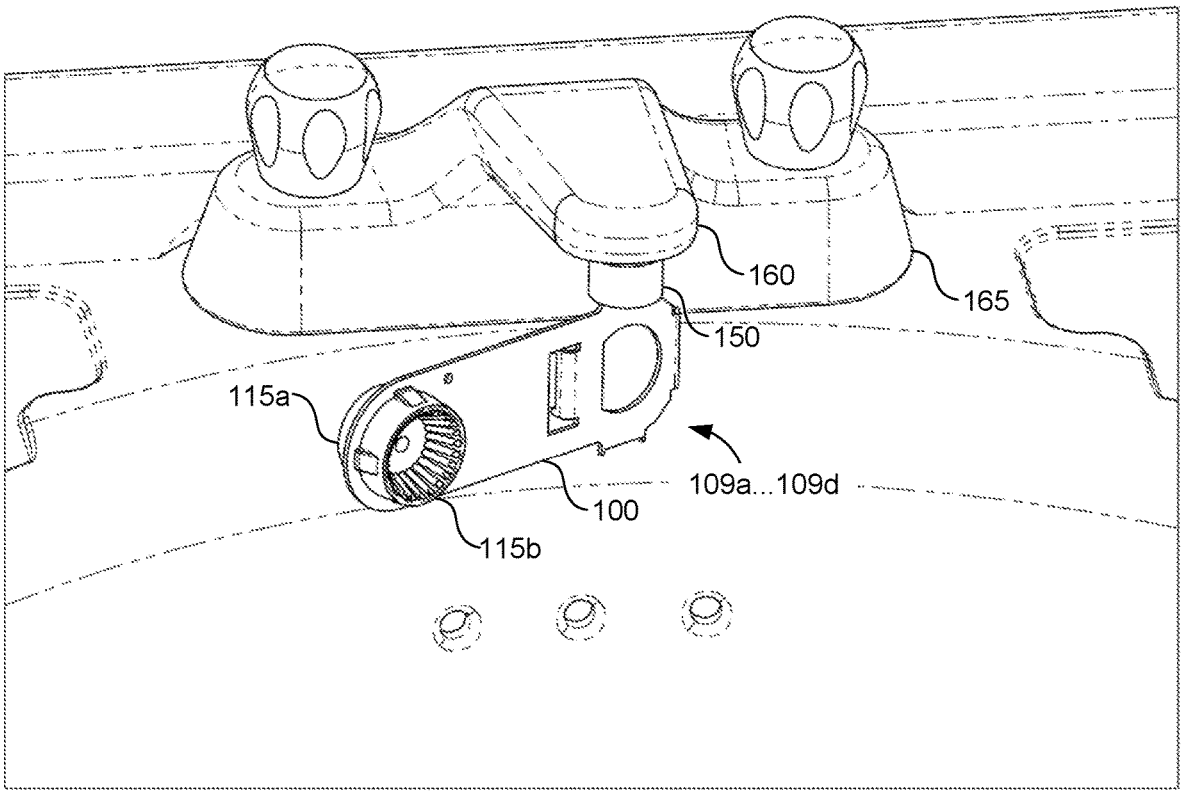
Figure 29:
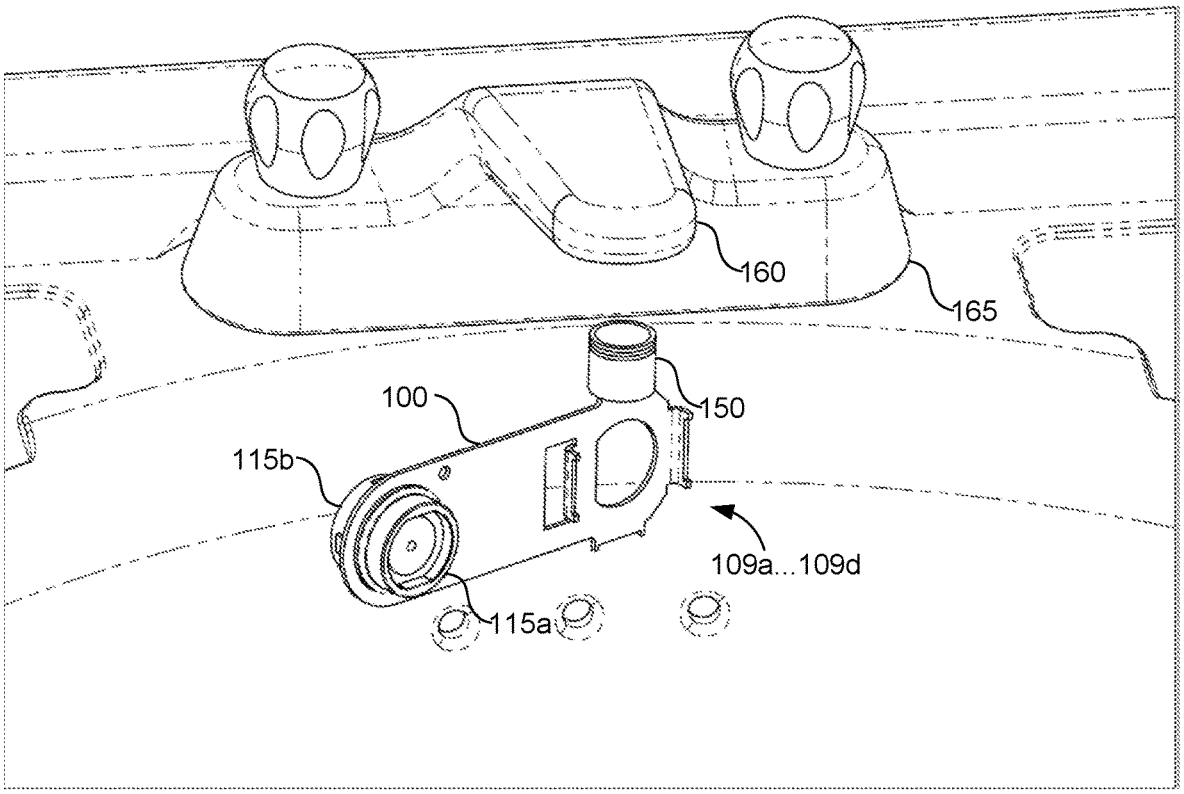
Figure 30:
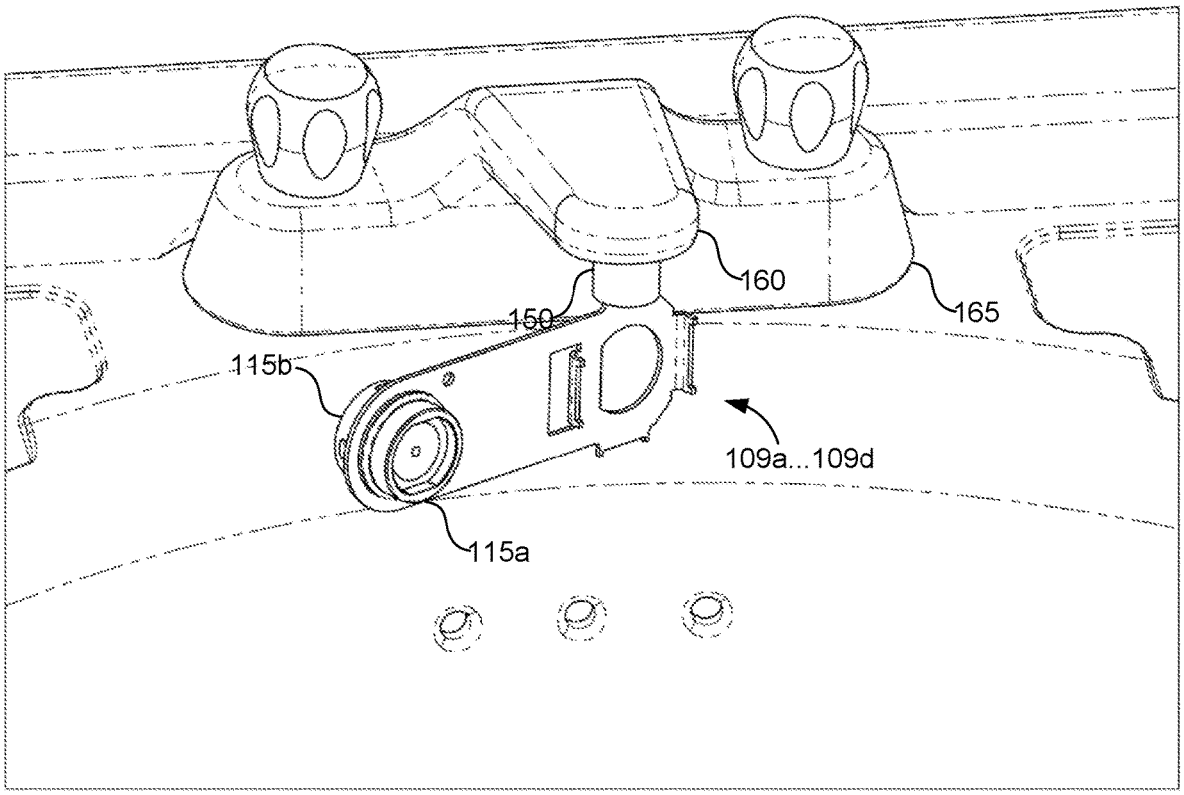

Turning now to FIGS. 7, 8, 9, and 10 a top plan view, a side view, a bottom plan view, and another side view of the universal aerator tool 100 is shown having no aerator wrenches for illustrative purposes according to various embodiments of the present disclosure. The aperture 118 may include a shape to substantially conform to the first aerator wrench 115*a* and/or the second aerator wrench 115*b*. FIGS. 11-15 include various views of the first aerator wrench 115*a* for use in the universal aerator tool according to various embodiments of the present disclosure. FIG. 16 includes a cross-sectional view of the first aerator wrench 115*a*. FIGS. 17-21 include various views of the second aerator wrench 115*b* for use in the universal aerator tool according to various embodiments of the present disclosure. FIG. 22 includes a cross-sectional view of the second aerator wrench 115*b*.

Moving on to FIGS. 23-34, various views are shown to illustrate an example operation of the universal aerator tool 100 according to various embodiments of the present disclosure. Namely, the universal aerator tool 100 is shown during operation to rotationally engage and turn various of types of aerators 150 positioned within or otherwise coupled to a spout 160 of a water faucet 165. An appropriate portion of the universal aerator tool 100, such as one of the keys 109 or wrenches 115, is coupled to the aerator 150 and the tool body 103 is rotated clockwise or counter-clockwise to install or remove the aerator 150 from the spout 160.

Figure 31:
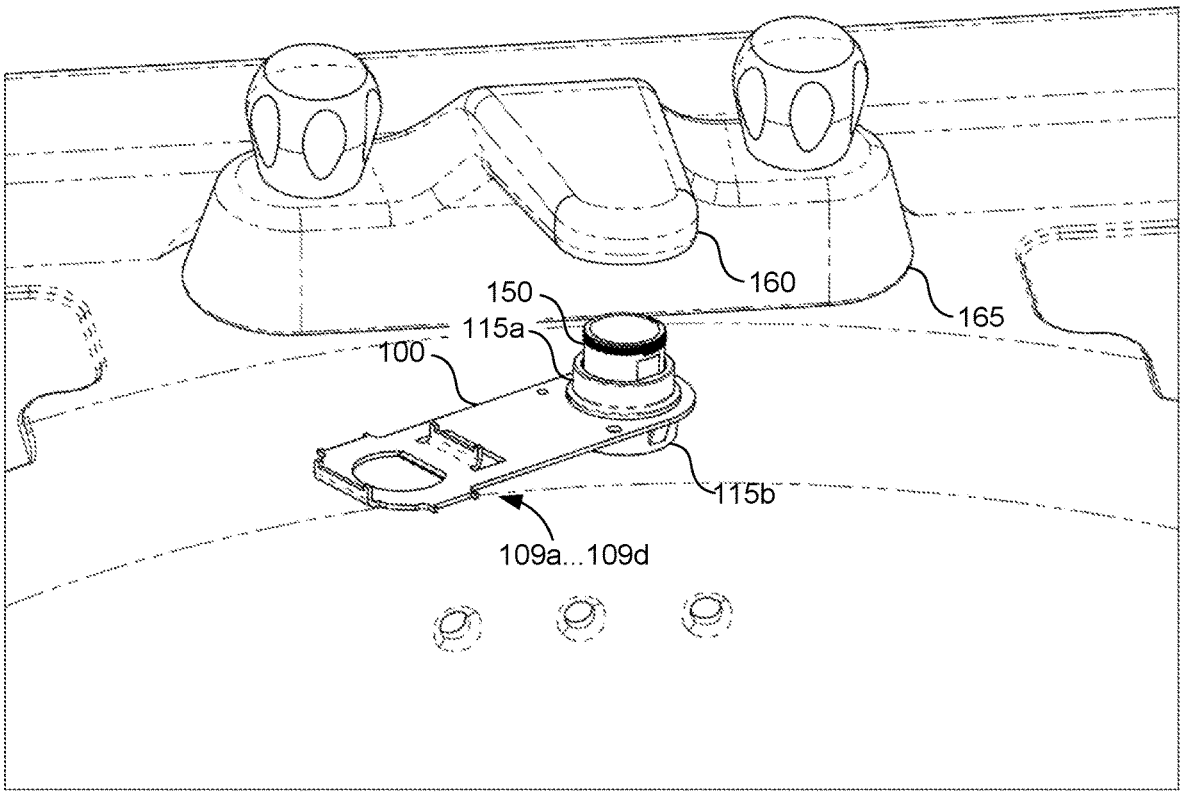
Figure 32:
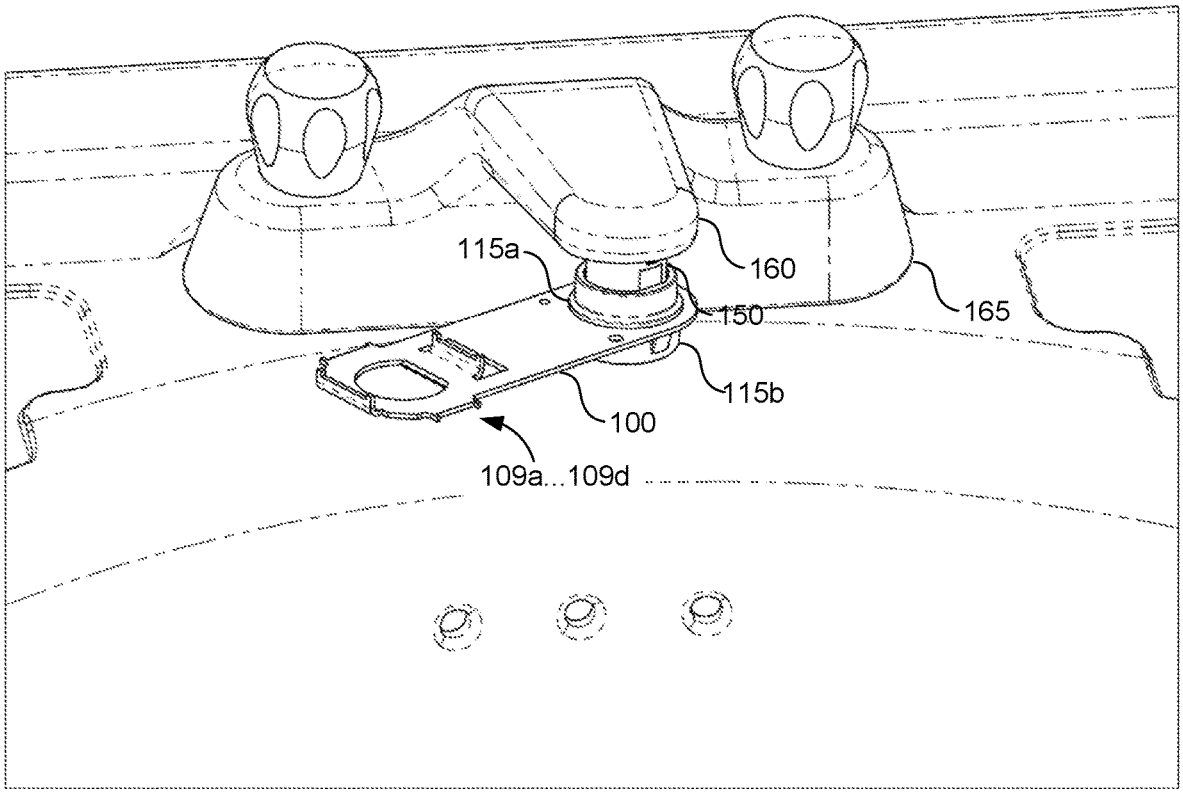
Figure 33:
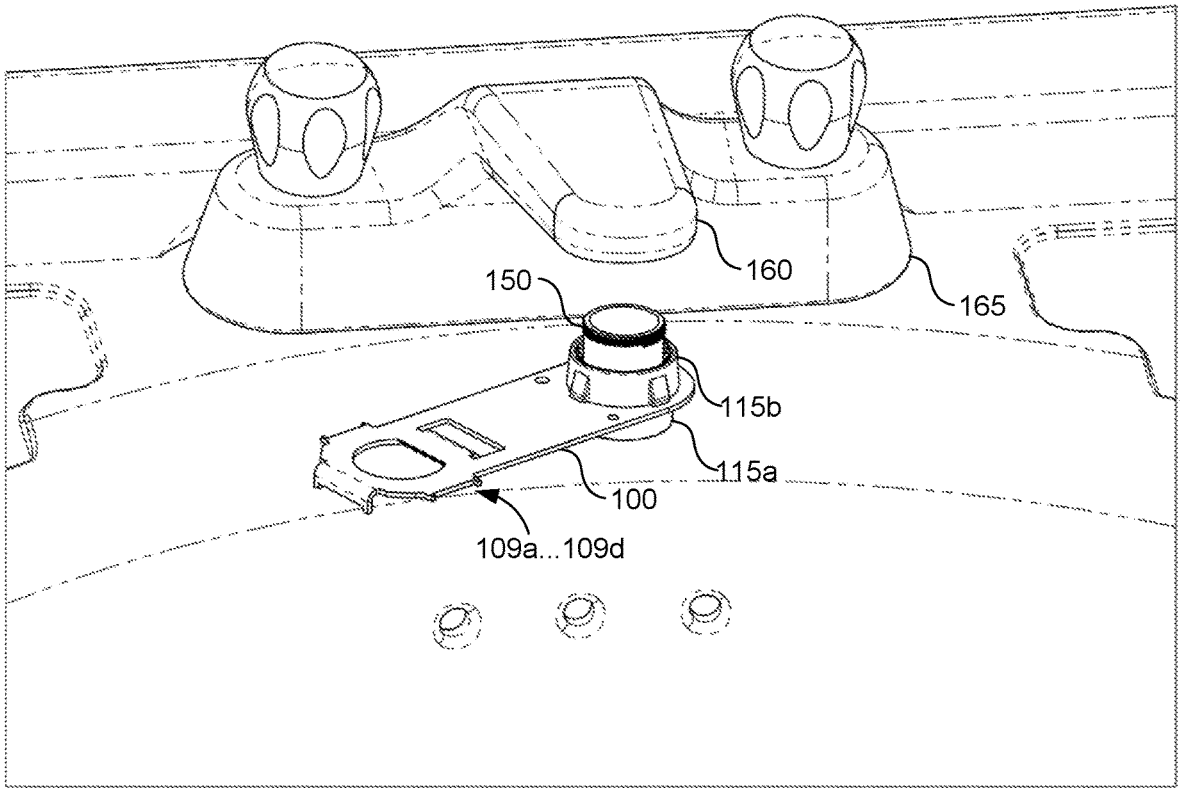
Figure 34:
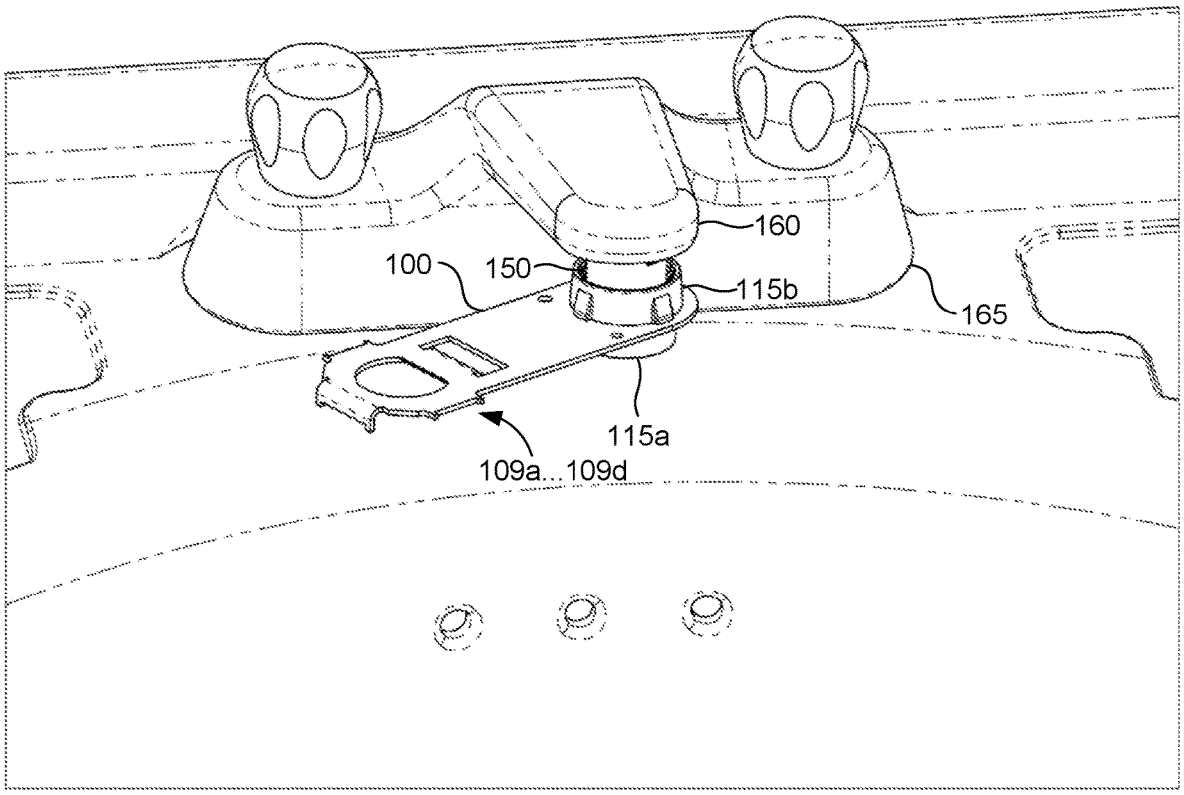

Different portions of the universal aerator tool 100 may be used depending on a type or configuration of the aerator 150. For instance, the keys 109 may be utilized to turn cache-type or hidden aerators 150 disposed within the spout 160. Alternatively, the aerator wrenches 115 may be utilized to engage and turn external-type aerators 150. Referring specifically to FIGS. 31 and 32, keyless-type aerators 150 may include those that are round with flat sides on its circumference, as shown in FIGS. 31-32. Referring specifically to FIGS. 33-34, the second aerator wrench 115*b* is shown having a circular ridged recess 140 with ridges or grips on its inside diameter that grip onto an outside round portion of the aerator 150 shown, as shown in FIG. 33.

Figure 35A:
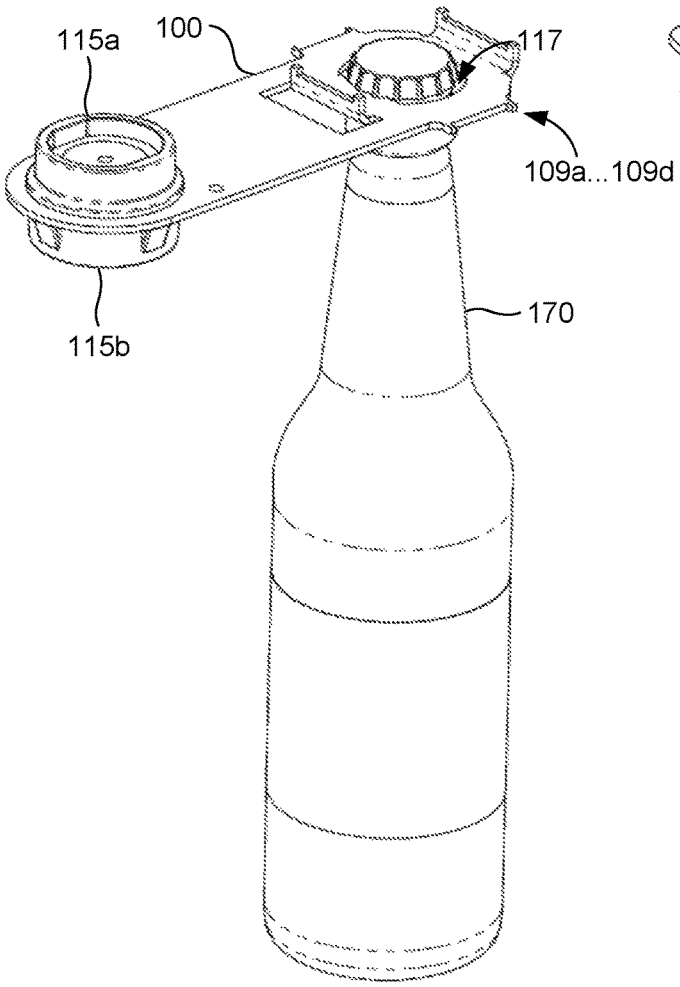
FIGS. 35A and 35B are various views showing another example operation of the universal aerator tool according to various embodiments of the present disclosure.
Figure 35B:
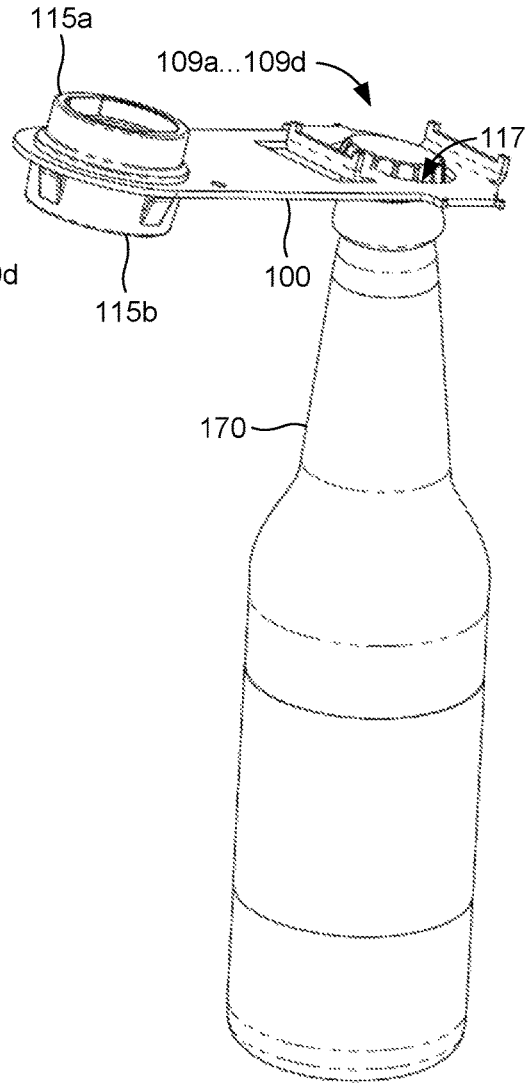

FIGS. 35A and 35B are various views showing another example operation of the universal aerator tool according to various embodiments of the present disclosure. The aperture 117 of the tool body 103, in some embodiments, may be operationally configured to receive and leverage a bottle cap off of a bottle 170, as illustrated in FIG. 35A and FIG. 35B.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A tool for rotationally engaging and turning an aerator coupled to a faucet spout, comprising:

a tool body having a first surface side, a second surface side, a first end, and a second end;

a plurality of keys positioned at the first end of the tool body, wherein at least one of the plurality of keys comprises a plurality of projections configured to rotationally engage and turn at least a first type of aerator; and a first aerator wrench at the second end of the tool body and projecting outwardly from the first surface side of the tool body, the first aerator wrench being configured to rotationally engage and turn a second type of aerator; and a second aerator wrench at the second end of the tool body and projecting outwardly from the second surface side of the tool body, the second aerator wrench being configured to rotationally engage and turn a third type of aerator; and wherein the first aerator wrench and the second aerator wrench are detachably attached through an aperture positioned at the second end of the tool body using a plurality of tabs, wherein the tool body is positioned between the first aerator wrench and the second aerator wrench.

2. The tool of claim 1, wherein:

the first type of aerator is one of: M24x1 (Regular), M21.5x1 (Junior), M18.5x1 (Tiny Junior), and M16.5x1 (TOM THUMB); and the second type of aerator is different than the first type of aerator and is one of M24x1 (Regular), M21.5x1 (Junior), M18.5x1 (Tiny Junior), and M16.5x1 (TOM THUMB).

3. The tool of claim 1, wherein the tool body comprises another aperture positioned on the first end of the tool body, the aperture operationally configured to receive and leverage a bottle cap off of a bottle.

4. The tool of claim 1, wherein at least a portion of the tool is magnetic.

5. The system of claim 1, wherein the second aerator wrench has a circular ridged recess comprising a plurality of ridges inside a diameter of the circular ridged recess configured to grip onto an outside of the third type of aerator.

6. The system of claim 1, wherein a bottom of the first aerator wrench is configured to substantially conform to a top of the second aerator wrench, thereby forming a coupling between the first aerator wrench and the second aerator wrench through the aperture.

7. The tool of claim 1, wherein:

the first aerator wrench comprises a partially circular recess having two flat edges position parallel and on opposing sides of the partially circular recess; and the second aerator wrench comprises a circular ridged recess having a plurality of ridges projecting axially and outwardly.

8. The tool of claim 7, wherein:

at least a portion of the first aerator wrench is formed of at least one of: acrylonitrile butadiene styrene (ABS), polyvinyl chloride (PVC), polyoxymethylene (POM), and polypropylene (PP); and at least a portion of the second aerator wrench is formed of at least one of: injection grade silicone, thermoplastic elastomers (TPE), thermoplastic rubber (TPR), and rubber.

9. The tool of claim 1, wherein the plurality of keys comprise:

a first key curvedly projecting from a distal end of the tool body configured to rotationally engage and turn the first type of aerator;

a second key projecting from a first lateral side of the tool body configured to rotationally engage and turn a third type of aerator;

a third key projecting from a second lateral side of the tool body configured to rotationally engage and turn a fourth type of aerator; and a fourth key curvedly projecting from a central portion of the tool body configured to rotationally engage and turn a fifth type of aerator.

10. The tool of claim 9, wherein the forth key is positioned at a rectangular-shaped aperture in a central region of the tool body.

11. A method for rotationally engaging and turning an aerator coupled to a faucet spout, comprising:

providing a tool, the tool comprising:

a tool body comprising a first surface side, a second surface side, a first end, and a second end;

a plurality of keys positioned at the first end of the tool body, wherein at least one of the plurality of keys comprises a plurality of projections configured to rotationally engage and turn at least a first type of aerator;

a first aerator wrench at the second end of the tool body and projecting outwardly from the first surface side of the tool body, the first aerator wrench being configured to rotationally engage and turn a second type of aerator; and a second aerator wrench at the second end of the tool body and projecting outwardly from the second surface side of the tool body, the second aerator wrench being configured to rotationally engage and turn a third type of aerator; and wherein the first aerator wrench and the second aerator wrench are detachably attached through an aperture positioned at the second end of the tool body using a plurality of tabs, wherein the tool body is positioned between the first aerator wrench and the second aerator wrench;

positioning one of the plurality of keys, the first aerator wrench, and the second aerator wrench to rotatably engage with the aerator coupled to the faucet spout; and removing the aerator from the faucet spout by turning the tool.

12. The method of claim 11, wherein:

the first type of aerator is one of: M24x1 (Regular), M21.5x1 (Junior), M18.5x1 (Tiny Junior), and M16.5x1 (TOM THUMB); and the second type of aerator is different than the first type of aerator and is one of: M24x1 (Regular), M21.5x1 (Junior), M18.5x1 (Tiny Junior), and M16.5x1 (TOM THUMB).

13. The method of claim 11, wherein the tool body comprises another aperture positioned on the first end of the tool body, the aperture operationally configured to receive and leverage a bottle cap off of a bottle.

14. The method of claim 11, wherein at least a portion of the tool is magnetic.

15. The method of claim 11, wherein the second aerator wrench has a circular ridged recess comprising a plurality of ridges inside a diameter of the circular ridged recess configured to grip onto an outside of the third type of aerator.

16. The method of claim 11, wherein a bottom of the first aerator wrench is configured to substantially conform to a top of the second aerator wrench, thereby forming a coupling between the first aerator wrench and the second aerator wrench through the aperture.

17. The method of claim 11, wherein:

the first aerator wrench comprises a partially circular recess having two flat edges position parallel and on opposing sides of the partially circular recess; and the second aerator wrench comprises a circular ridged recess having a plurality of ridges projecting axially and outwardly.

18. The method of claim 17, wherein:

at least a portion of the first aerator wrench is formed of at least one of: acrylonitrile butadiene styrene (ABS), polyvinyl chloride (PVC), polyoxymethylene (POM), and polypropylene (PP); and at least a portion of the second aerator wrench is formed of at least one of: injection grade silicone, thermoplastic elastomers (TPE), thermoplastic rubber (TPR), and rubber.

19. The method of claim 11, wherein the plurality of keys comprise:

a first key curvedly projecting from a distal end of the tool body configured to rotationally engage and turn the first type of aerator;

a second key projecting from a first lateral side of the tool body configured to rotationally engage and turn a third type of aerator;

a third key projecting from a second lateral side of the tool body configured to rotationally engage and turn a fourth type of aerator; and a fourth key curvedly projecting from a central portion of the tool body configured to rotationally engage and turn a fifth type of aerator.

20. The method of claim 19, wherein the forth key is positioned at a rectangular-shaped aperture in a central region of the tool body.

* * * * *